United States Patent [19]

Spencer

[11] Patent Number: 4,825,776

[45] Date of Patent: May 2, 1989

[54] RAILWAY TRUCK FRICTION SHOE WITH RESILIENT PADS

[75] Inventor: Charles P. Spencer, Staunton, Ill.

[73] Assignee: AMSTED Industries Incorporated, Chicago, Ill.

[21] Appl. No.: 83,049

[22] Filed: Aug. 10, 1987

[51] Int. Cl.[4] ..... B61F 5/24

[52] U.S. Cl. ..... 105/198.5; 105/198.7

[58] Field of Search ..... 105/197.05, 198, 198.2, 105/198.4, 198.5, 198.7, 225

[56] References Cited

U.S. PATENT DOCUMENTS

| | | | |
|---|---|---|---|
| Re. 31,784 | 1/1985 | Wiebe . | |
| Re. 31,988 | 9/1985 | Wiebe . | |
| 2,257,109 | 9/1941 | Davidson | 105/198.5 |
| 2,564,771 | 8/1951 | Spence | 105/198.7 X |
| 3,342,139 | 9/1967 | Tack | 105/198.5 X |
| 3,517,620 | 6/1970 | Weber | 105/198.7 X |
| 3,901,163 | 8/1975 | Newmann | 105/198 |
| 4,103,623 | 8/1978 | Radwill . | |
| 4,109,585 | 8/1978 | Brose . | |
| 4,256,041 | 3/1981 | Kemper et al. . | |
| 4,274,340 | 6/1981 | Neumann et al. . | |
| 4,380,199 | 4/1983 | Thomson et al. | 105/225 |

OTHER PUBLICATIONS

Photograph of "Stucki Friction Shoe", A. Stucki Co., Pittsburg, PA.

*Primary Examiner*—Stephen Hepperle

*Attorney, Agent, or Firm*—Edward J. Brosius; Charles E. Bouton

[57] ABSTRACT

The present invention provides a friction shoe for use in a railway freight car truck. The friction shoe consists of a cast metal body having a generally flat vertical surface adapted to abut a column on the truck side frame and sloped surfaces adapted to abut a corresponding sloped surface of the truck bolster. Resilient, elastomeric pads are adapted to be received on each sloped surface of the friction shoe. The sloped surface of the friction shoe has either a slot or a protrusion running lengthwise parallel to an outer edge of the sloped surface, and the elastomeric pad has either a correspoding protrusion or slot adapted to fit in the complementary sloped surface. The elastomeric pad may be wedge shaped tapering in reduced thickness from its bottom edge toward its top edge, or the pad may comprise two components each of which tapers from its top edge toward its bottom edge with a complementary adapted sloped surface on the friction shoe.

6 Claims, 4 Drawing Sheets

RAILWAY TRUCK FRICTION SHOE WITH RESILIENT PADS

BACKGROUND OF THE INVENTION

The present invention relates generally to friction shoes for use in railway car trucks and, more particularly, to friction shoes having a resilient, elastomeric pad on the sloped faces thereof.

Railway freight car trucks generally comprise two wheelsets mounted on axles, with both axles joined by and supporting side frame castings. The side frame castings are located outboard of the railway wheels, and are mounted on the axles by roller bearing assemblies with adapters. A bolster casting is centrally mounted parallel to the wheel axles in the side frame castings. Each end of the bolster is supported in the respective side frame casting by a spring group. Depending on the loading characteristics of the railway car, the spring group can comprise a various number of outer coils, inner coils or shock absorbing devices. Typical railway freight cars have nine spring positions.

Each side frame includes two centrally located vertical columns which extend from the bottom of the spring group support floor to the upper compression member of the side frame casting. These side frame columns form an opening for the end of the bolster.

The weight of the railway freight car is supported by the side bearings and center plate of the bolster. Two major types of car instability are directly related to the type of interconnection between the bolster end and the side frame bolster opening. These instabilities are truck hunting which usually occurs at high speeds wherein the truck turns out of square with the rails causing it to weave down the track, usually with the wheel flanges striking the rails. Further, truck lozenging can accompany such hunting wherein the bolster turns out of square with the side frames. The other type of instability is referred to as rock and roll which refers to an excessive lateral rocking of the freight cars, usually occurring at low speeds. Solutions to both types of instability include the provision of a winged friction shoe between each side frame column and the adjacent bolster side. Accordingly, each bolster end includes two friction shoe pockets, each comprising two sloped surfaces against which corresponding sloped surfaces of the friction shoe abut. The friction shoe also includes a generally flat, generally vertical face which abuts a friction wear plate welded and/or bolted to each side frame column.

The lever arm provided by the winged friction shoe acts to square the bolster with the side frame which helps to reduce the wheel/rail angle of attack on curves and accordingly, reduce the possibility of truck hunting. Further, the damping affect of the friction shoe surfaces against both the sloped surfaces of the bolster friction shoe pocket and the side frame column friction plate tend to provide a dampening force to the oscillations of the bolster in the side frame spring pocket to lessen lateral rocking of the freight car.

Due to the relatively high cost of the truck bolster, it is undesirable for the sloped surfaces of the generally harder friction shoe to wear into the bolster sloped surfaces. Excessive wear in the bolster sloped surfaces eventually requires the replacement of the bolster, as repair of such surfaces is impractical.

SUMMARY OF THE INVENTION

An object of the present invention is to provide an improved railway car friction shoe having a much less tendency to wear away the sloped surface of the bolster friction pocket.

The sloped surfaces of each friction shoe are provided with resilient pads which greatly lessen the possibility of the friction shoes wearing metal away from the corresponding sloped surface of the friction shoe pocket in the bolster. The resilient pads are typically formed of an elastomeric material which can be any of various elastic substances such as polyvinyl elastomers. The particular hardness and coefficient of friction for the elastomer are so chosen for optimal truck squaring and snubbing properties as well as wearability of the elastomer material itself. A coil spring or coil spring assembly has its upper end acting against an internal upper surface of the friction shoe while the lower end of the spring acts against an extended ledge portion of the bolster. Such an arrangement provides a friction snubbing force acting between the bolster and the side frame column.

The particular interface between the friction shoe sloped surface and the elastomeric pad is so arranged so as to provide a minimum of motion between the pad and the sloped surface to minimize wear or abrasion between such surfaces. A wedge shaped pad with complementary sloped seat on the sloped surface of the friction shoe have been found to cause the elastomer pad to, in effect, remain in a downward position against a lower abutting surface on the sloped face of the friction shoe. The taper of the elastomeric pad such that its thickness increases from its top end toward its bottom end acts as an open ended stop on the upper end of the friction shoe sloped surface to minimize the tendency of the elastomer pad from sliding upwardly along the sloped surface. Such wedge shaped pads also provide increased damping when the friction shoe is pushed upward or into the friction shoe pocket of the bolster to help decrease the tendency for truck hunting. Further, when the bolster is pushed downwardly relative to the side frame column, extra damping is provided by such wedge shape to dissipate the tendency of the bolster to oscillate or bounce to thereby decrease the tendency of the car to rock.

It may be desirable to provide a multiple layered elastomer pad to provide both optimal surface material conditions for extended wear and a base surface material of a lower shear load rate and a higher coefficient of friction to provide a lesser tendency of the pad to slide against its receiving sloped surface on the friction shoe.

It may also be desirable to provide an elastomer pad comprising two elements, an upper element tapered in a first vertical direction fitted against a complementary tapered surface of the friction shoe sloped surface and a lower element of an opposite taper to the upper element again fitted against a complementary tapered sloped surface.

It may also be desirable to provide a protrusion or slot running vertically along a generally central portion of the back face of the elastomeric pad with a complementary slot or extension running along the sloped surface of the friction shoe. Such complementary slot and protrusions on the back surface of the elastomer pad and the sloped surface would assure the lateral stability of the elastomer pad on the sloped surface.

DESCRIPTION OF THE PREFERRED EMBODIMENT

Figures 1, 2, 2A:
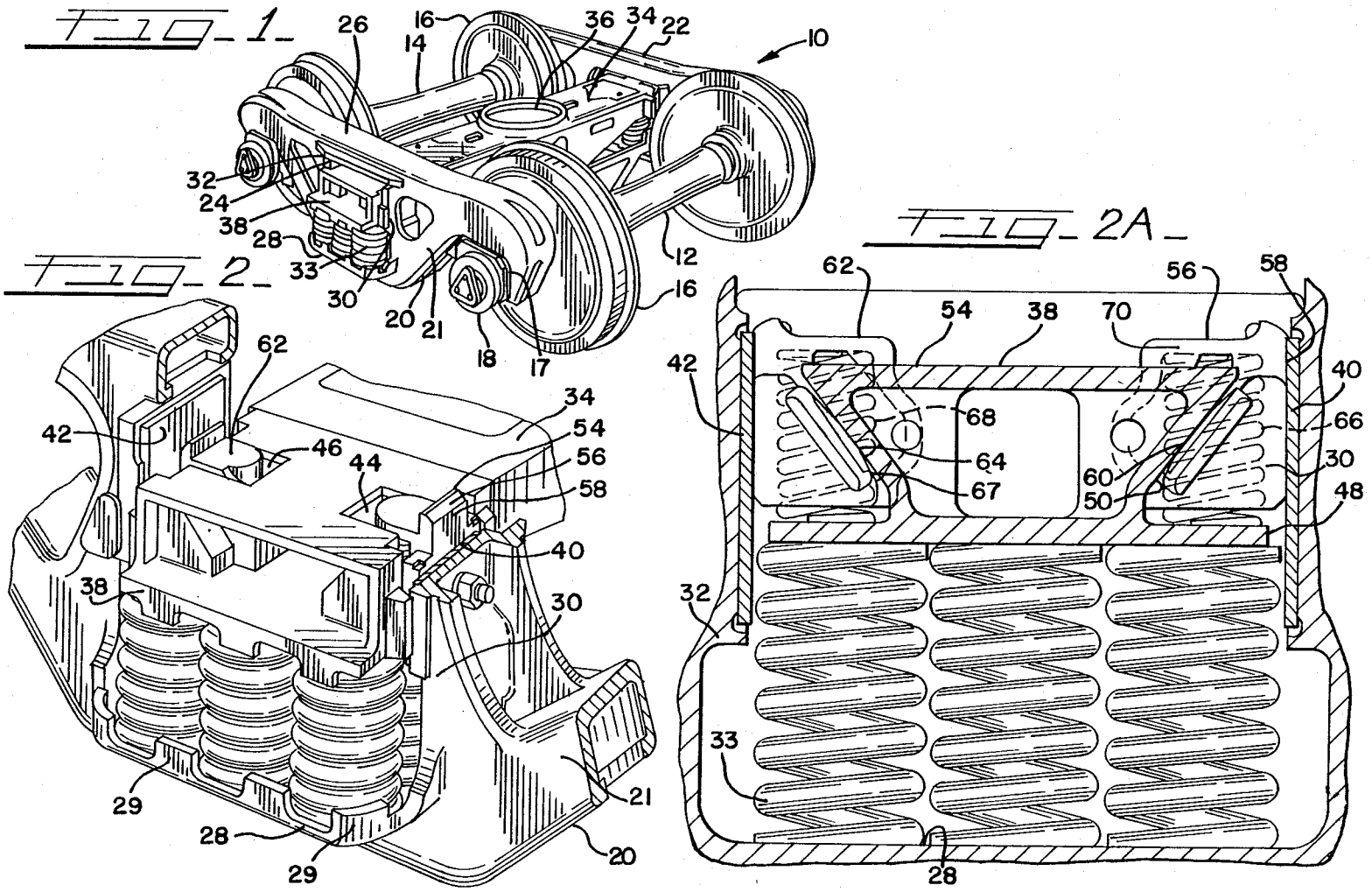
FIG. 1 is a perspective view of a railway truck.
FIG. 2 is a detailed, partially cut away, partially exploded view of the interface between the end portion of the bolster and the side frame column bolster opening.
FIG. 2A is a partial, detailed cut away end view of the bolster end received in the side frame column bolster opening.

Referring now to FIG. 1 of the drawings, a railway truck is shown generally at 10. The truck comprises a pair of axles 12, 14 each of which support two railway wheels 16. The end of each of the axles 12, 14 include roller bearing assemblies 18 which are mounted in a pedestal jaw opening 17 in side frames 20 and 22. It will be understood that all features of side frame 20 are also present in side frame 22, but are not visible in FIG. 1. Side frame 20 is comprised of tension members 21 extending downwardly from pedestal jaw opening 17, side frame columns 30 and 32 extending upwardly from the lower portion of tension member 21 to the compression member 26 which is the uppermost portion of side frame 20. Side frame columns 30, 32 are generally vertical, and form a bolster opening 24 therebetween. A bottom spring support shelf 28 extends outwardly from a lower section of side frame 20 to receive the bottom end of spring group load coils 33. A bolster 34 extends parallel to axles 12, 14 and has ends each extending through one of the side frame bolster openings. Each bolster includes a center plate 36 through which the freight car body bolster center plate is received.

Referring now to FIGS. 2 and 2*a*, detailed views of bolster end 38 extending through side frame bolster opening 24 are shown. The bottom section 28 of side frame 20 is seen to comprise upraised sections 29 adapted to receive coil springs 33 in a prearranged pattern. Side frame column 30 is seen to have a bolted and welded wear plate 40 on the surface facing bolster opening 24, and side frame column 32 is seen to have a bolted and welded wear plate 42 on its internal section facing bolster opening 24. Both side frame column friction wear plates 40 and 42 are generally planar and extend in a generally vertical direction. Such wear plates provide a replaceable surface against which a snubbing force from bolster end 38 can be directed without structural wear on either side frame column 30 or 32.

Bolster end 38 is seen to include two friction shoe pockets 44 and 46. Friction shoe pockets 44 and 46 are mirror images of each other and accordingly friction shoe pocket 44 will be described in detail. This friction shoe pocket 44 extends inwardly into a lateral edge of bolster end 38 and includes a base section 48 and two sloped side walls 50 and 52 extending downwardly at an acute angle from upper surface 54 of bolster 34. A friction shoe 56 is adapted to be received within friction shoe pocket 44. Friction shoe 56 comprises a cast metal body including a generally planar, generally vertical front face 58, a central roof section 70 extending backward from a top section of friction shoe 56, and two sloped wing surfaces 60 (the other wing surface not being visible on friction shoe 56) extending downwardly at an acute angle from an upper portion of front face 58. Control spring 66 is adapted to be received within an opening in the bottom of friction shoe 56 and extend upwardly and contact the lower section of roof portion 70 of friction shoe 56. Control spring 66 has a bottom edge resting on bottom section 48 of friction shoe opening 44 in bolster 34. Friction shoe 62 is adapted to be received in bolster opening 46 and is identical to friction shoe 56. For clarity, a sloped wing surface 64 of friction shoe 62 is shown.

As railway truck 10 travels down a railway track with the freight car supported thereon, bolster 34 is subjected to oscillations within the side frame bolster openings. Such oscillations are damped by coil spring group 33, but friction shoes 56 and 62 act especially to damp oscillating movement of bolster 34 in side frames 20 and 22. Such damping is provided by vertical friction wall 58 of friction shoe 56 and a similar wall of friction shoe 62 rubbing against side frame column friction plates 40 and 42. Further, sloped surfaces 50 (other surface not shown) of bolster opening 44 contact corresponding wing surfaces 60 (other wing surface not shown) of friction shoe 56. Sloped surfaces 64 of bolster opening 46 contact corresponding wing surfaces 67 (other wing not shown) of friction shoe 62. Sloped wing surface 60 of friction shoe 56 typically extends at an angle of about 37½° outwardly from front vertical face 58. Sloped surfaces 50 and 52 of bolster opening 44 extend at a similar angle from the vertical.

Figure 3:
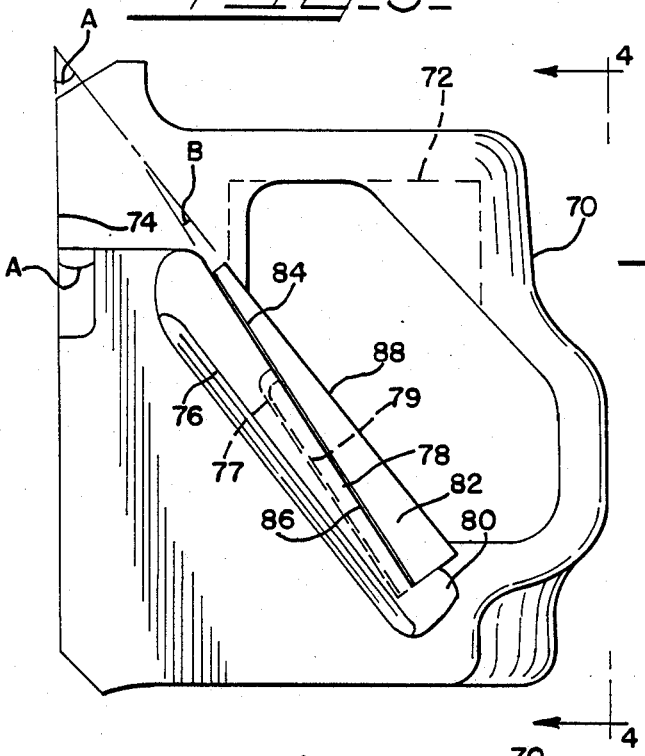
FIG. 3 is a side view of a first embodiment of a friction shoe in accordance with the present invention.
Figure 5:
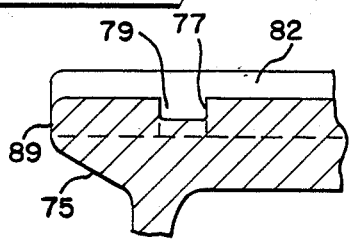
FIG. 5 is a cross section view of the wing and elastomeric pad along line 5—5 shown in FIG. 4.
Figure 4:
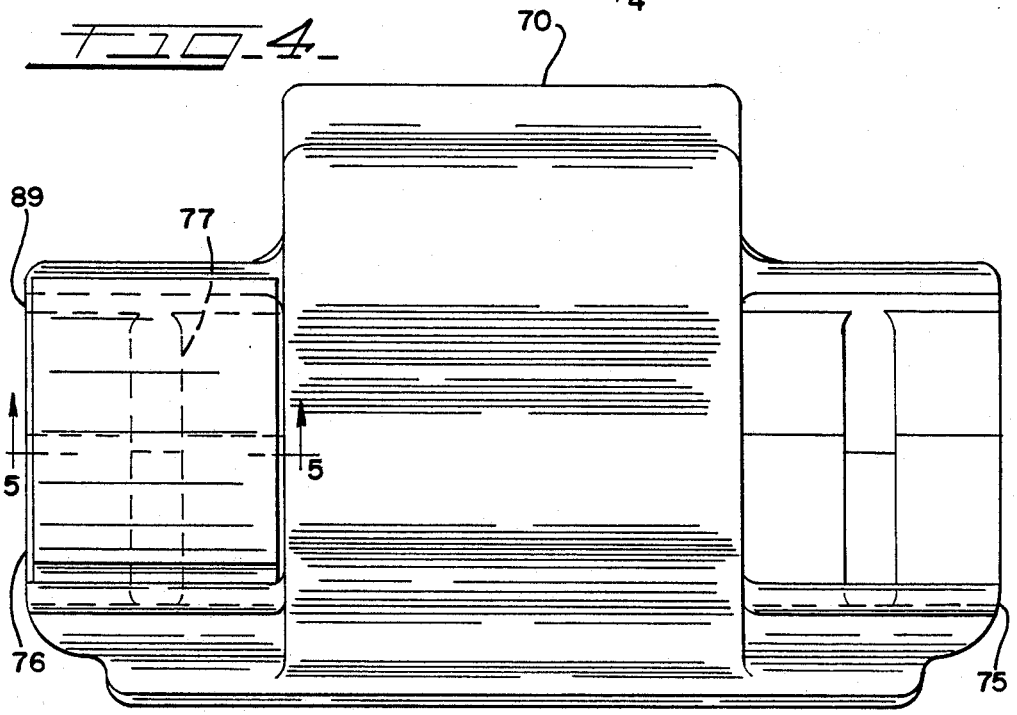
FIG. 4 is a front view of the friction shoe shown in FIG. 3.

Referring now to FIGS. 3–5 of the drawings, a friction shoe in accordance with the first embodiment of the present invention is shown generally at 70. Friction shoe 70 is comprised of a cast metal body having a generally flat vertical front face 74 with winged sloped surfaces 76 and 75 extending outwardly toward either side of friction shoe 70. A cavity 72 is provided within friction shoe 70 to accommodate the control spring. Each of wings 76 and 75 are similar with wing 76 being shown in cross section in FIG. 5. Wing 76 extends at an angle A, which is usually about 37½° from vertical face 74. Upper surface 78 of wing 76 is tapered in that it extends at an angle B from an angle A from vertical wall 74, with angle B being between 1° and 4°. Accordingly, upper surface 78 of wing 76 can be said to be tapered in that the upper portion of wing 76 is thicker than the lower portion of wing 76. Further, a bottom support 80 extends upward from wing lower surface 75 providing a stop support for elastomeric pad 82. Elastomeric pad 82 is tapered in that its thickness near its upper end 84 is less than its thickness near its lower end abutting support 80. The tapers of upper surface 78 of wing 76 and lower surface 86 of elastomer pad 82 are chosen to be complementary such that the upper surface 88 of elastomeric pad 82 is at angle A from vertical front face 74.

Friction shoe wing 76 includes an indentation 77 running lengthwise for a portion of the length of upper surface 78 of wing 76 to bottom stop 80. Indentation or slot 77 is elongated and parallel to edge 89 of wing 76. A corresponding protrusion 79 extends from the back surface of elastomeric pad 82 and is received within slot 77. Slot 77 is generally at a midpoint of the width of wing 76, and protrusion 79 is generally at a midpoint of the width of elastomeric pad 82. Alternatively, elastomeric pad 82 can have a slot extending into its undersurface, and wing sloped surface 78 can have an extension protruding therefrom adapted to be received in the corresponding slot of the lower surface of elastomeric pad 82.

Figure 6:
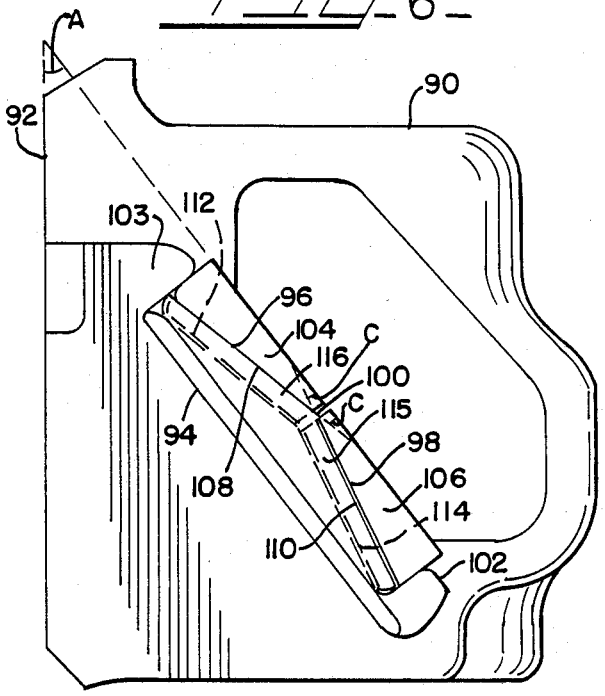
FIG. 6 is a side view of a second embodiment of a friction shoe in accordance with the present invention.

Referring now to FIG. 6, the second embodiment of the friction shoe of the present invention is shown generally at 90. Friction shoe 90 includes a generally flat, generally vertical front face 92, with two wings extending widthwise from the body of the friction shoe with only wing 94 being visible in FIG. 6. Wing 94 extends at an angle A of about 37½° from front face 92. Wing 94 has an upper face having a top section 96 and a lower section 98. Top section 96 is generally planar and extends toward line apex 100 wherein it is joined with bottom generally planar section 98. A bottom extension section 102 extends outwardly from planar section 98, as does a similar upper extended section 103 extend outwardly from the upper portion of upper section 96. Upper elastomeric pad 104 is generally wedge shaped having a decreasing thickness from its top toward its bottom portion. Its bottom portion is adjacent to apex 100 of wing surface 94. Bottom elastomeric pad 106 is tapered from its top section near apex 100 of sloped surface 94 in increasing thickness toward its bottom section adjacent and abutting lower support 102. The taper of upper elastomeric pad 104 is seen in its angle extension to the top of elastomeric pad 106 as forming angle C therewith, angle C being from 4° to 8°. Lower elastomeric pad 106 is similarly tapered with its angle extended to the top of upper elastomeric pad 104 also being angle C of from 4° to 8°. Upper surface 96 of friction shoe wing 94 is complementarily tapered with the bottom surface 108 of upper elastomeric pad 104; accordingly, it can also be said to be tapered at angle C of from 4° to 8°. Upper surface 98 of the lower section of wing surface 94 is tapered at an angle complementary to the taper of rear surface 110 of lower elastomeric pad 106; accordingly, upper surface 98 can be said to be tapered at angle C of from 4° to 8° from the upper surface of both elastomeric pads.

Upper elastomeric pad 104 includes a vertical extension or protrusion 116 extending from its rear surface 108. Protrusion 116 is vertical in direction and parallels a side edge of upper pad 104. A complementary indentation or slot 112 is provided in upper portion 96 of wing 94 to accommodate the protrusion 116. Similarly, a protrusion 115 extends from the rear side of elastomeric pad 106 in a vertical direction parallel to a side edge thereof. A complementary slot 114 is provided in lower surface 98 of wing 94 wherein protrusion 115 can be received.

Figure 7:
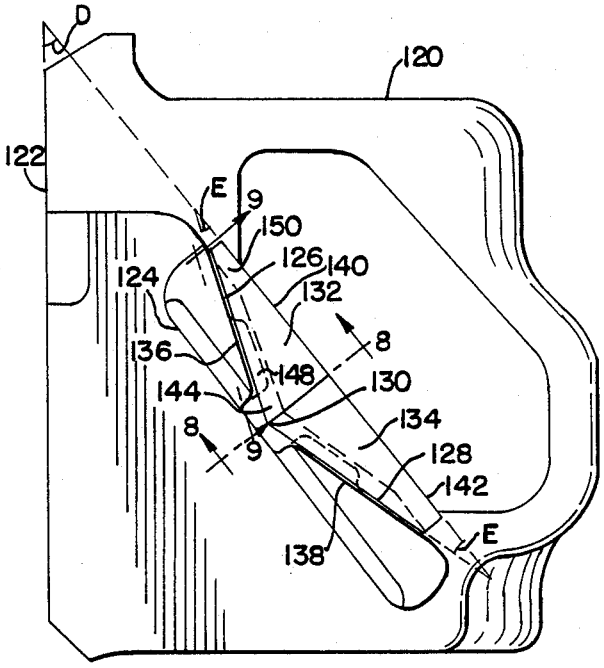
FIG. 7 is a side view of a third embodiment of a friction shoe in accordance with the present invention.

Referring now to FIG. 7, another embodiment of the present invention is shown as friction shoe 120. Friction shoe 120 includes a generally flat, generally vertical front face 122 and wing elements one of which is shown at 124 extending at one side of friction shoe 120 at an acute angle D from an extension of front face 122. A similar wing surface is on the other side of fiction shoe 120 not visible in FIG. 7. Wing extension 124 is comprised of an upper wedge shaped section 126 and a lower wedge shaped section 128 both of which taper inwardly toward their central junction point 130. Upper wing section 126 tapers inwardly at an acute angle E of about 4° to 8° from angle D which is at about 37½° from front face 122. Lower wing section 128 tapers inwardly at a similar angle E.

The elastomeric pad for friction shoe 120 comprises an upper wedge shaped section 132 and a lower wedge shaped section 134. Upper section 132 includes a flat upper surface 140 and a tapered lower surface 136. Lower surface 136 is tapered at angle E from an extension in line with upper surface 140 which itself extends at angle D from front face 122. Lower pad section 134 is similarly comprised of a flat upper surface 142 and a tapered lower surface 138 which extends at angle E from an extension of front surface 142. Pad sections 132 and 134 abut along a line extended from the center junction 130 of wedge extension faces 126 and 128.

Figure 9:
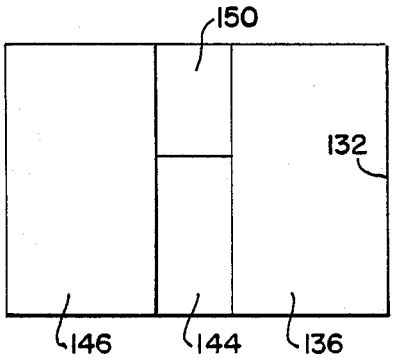
FIG. 9 is a detailed back view of the elastomeric pad generally along lines 9—9 shown in FIG. 7.
Figure 8:
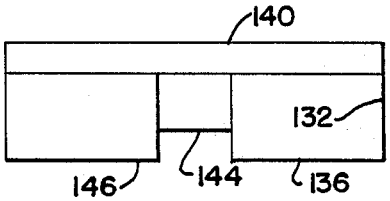
FIG. 8 is a detailed cross section view of the elastomeric pad along line 8—8 shown in FIG. 7.

Referring now to FIGS. 8 and 9, detailed end and back views of pad section 132 are shown. Upper pad section 132 is seen to comprise generally flat upper surface 140 with two separate wedge lower surfaces 136 and 146 separated by an indentation or slot 144. Slot 144 does not extend for the entire length of rear surfaces 136 and 146, but rather tapers away when adjacent upper section 150 of upper pad 132. An alternative embodiment of the arrangement shown in FIGS. 7–9 would be to have the elastomeric pad include an extension on its lower surface with the sloped upper surfaces of the wing extension having indentations to receive such protrusion.

Figure 10:
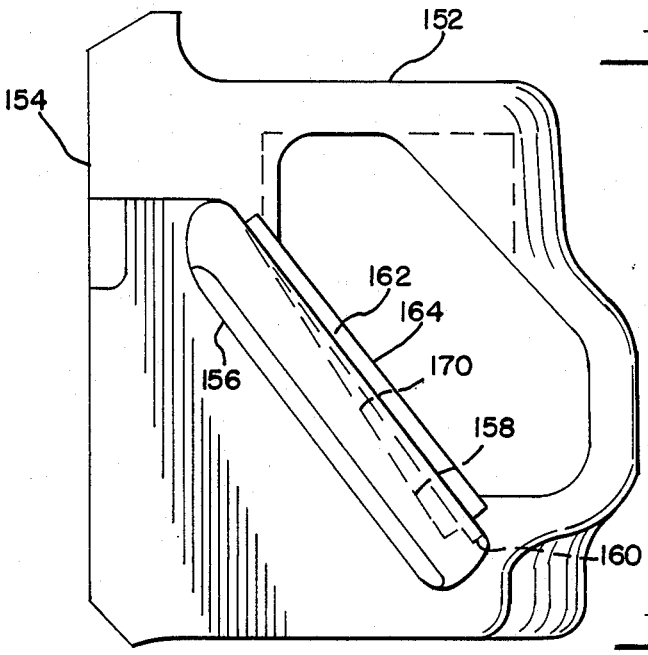
FIG. 10 is a side view of a fourth embodiment of a friction shoe in accordance with the present invention.
Figure 11:
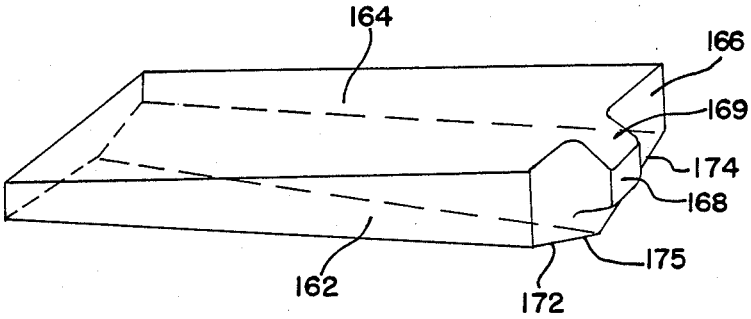
FIG. 11 is a perspective view of the elastomeric pad shown in FIG. 10.

Referring now to FIGS. 10 and 11, another embodiment of the present invention is shown as friction shoe 152. Friction shoe 152 comprises a generally flat, generally vertical front face 154, with wing extension 156 extending from the side of shoe 152. A similar wing extends from the other side of shoe 152 and is not visible in FIG. 10. Wing surface 156 extends at an angle of about 37½° from front face 154. The upper surface 170 of wing surface 156 is tapered such that its indentation at its lower end is deeper than the indentation at its upper end. The indentation is a result of an angling of upper surface 170 of from 1° to 4° from the angle of wing surface 156 of about 37½° in relation to front face 154. Elastomeric pad 162 is generally wedge shaped and includes a generally flat upper surface 164. The lower surface of elastomeric pad 162 is comprised of two planar surfaces 172 and 174 which taper downwardly toward a junction line 175. Upper surface 170 of winged extension 156 has complementary sloped receiving surfaces such that elastomeric pad 162 is fitted into the upper surface of wing extension 156. Further, wing extension 156 includes a depression 160 at its lower surface adapted to receive an extension 168 from bottom surface 166 of elastomeric pad 162. Such extension with its upper sloped section 169 acts to keep elastomeric pad 162 within wing extension 156 during various actions of a corresponding sloped bolster pocket against upper surface 164 of pad 162. The complementary sloping of lower surfaces 172 and 174 of elastomeric pad 162 with the receiving surfaces of upper surface 170 of wing extension 156 act to provide lateral stability for friction shoe elastomeric pad 162.

Figure 12:
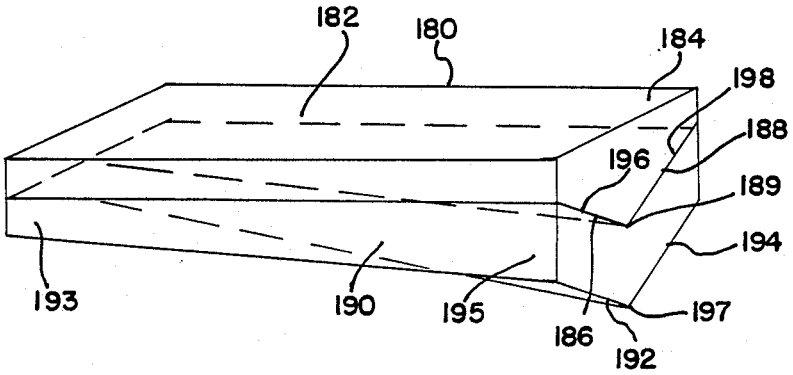
FIG. 12 is a perspective view of another embodiment of an elastomeric pad for use in a friction shoe in accordance with the present invention.

Referring now to FIG. 12, an alternate embodiment of an elastomeric pad which could be utilized in the friction shoe 152 of FIG. 10 is shown generally at 180. Elastomeric pad 180 is comprised of an upper section 184 and a lower section 190. Upper section 184 includes a generally flat upper surface 182 and two planar lower surfaces 186 and 188 which extend downwardly to form an apex line 189. Typically upper pad section 184 is of a relatively hard elastomer of relatively low coefficient of friction. An example of such material is nylatron.

Lower pad section 190 is tapered in thickness from its relatively thicker lower end 195 toward its thinner upper end 193. The upper surface of pad section 190 is comprised of two planar surfaces 196 and 198 joined at a central groove section into which apex 189 of upper pad surface 184 is fitted. The angling of upper surfaces 196 and 198 is complementary to the lower surfaces 186 and 188 of upper pad section 184. The lower surface of pad section 190 is comprised of two planar sections 192 and 194 joined along a central apex 197. Lower pad section 190 is comprised of a generally softer material than upper pad section 184 having a lower shear load rate and a relatively higher coefficient of friction than upper pad section 184. Accordingly, upon frictional movement of a bolster sloped surface against upper surface 182 of elastomeric pad 180, the upper pad material would allow relatively easy sliding of the bolster surface therealong. The interface of the lower surfaces 192 and 194 of lower pad section 190 against complementary receiving surfaces of a friction shoe wing extension would, due to the relatively higher coefficient of friction of such material, cause the lower pad section 190 to undergo shear to prevent the tearing or heavy abrasion at the contact of lower surfaces 192 and 194 with the receiving wing extension. Further, the softer lower shoe material 190 would conform better to the receiving wing extension to help evenly distribute load pressures received from the bolster sloped pocket through upper pad material 184.

What is claimed is:

1. A friction shoe for use in a railway car truck, said shoe comprising a metal base section having a generally vertical, generally flat front face and at least one sloped surface extending downwardly at an acute angle in relation to an upper portion of said front face, and an elastomeric pad adapted to be received on said sloped surface, said sloped surface having a slot running lengthwise of said sloped surface generally parallel to an outer edge of said sloped surface, and said elestomeric pad having a protrusion running lengthwise along its rear face generally parallel to an outer edge of said elastomeric pad, said elastomeric pad protrusion adapted to be received in said sloped surface slot, said sloped surface of said metal base section has an upper surface including said slot and a lower surface, said upper surface being inclined at a greater angle from an upper portion of said front face than said lower surface, and wherein said elastomeric pad is wedge shaped having a greater thickness at its lower end than at its upper end such that, upon insertion of said elastomeric pad into said sloped surface upper surface, the top surface of said elastomeric pad is in a generally parallel relation with the lower surface of the sloped surface.

2. The friction shoe of claim 1 including a lip formed along the bottom edge of said sloped surface upper surface such that the bottom edge of said elastomeric pad is supported against said lip.

3. A friction shoe for use in a railway car truck, said shoe comprising a metal base section having a generally vertical, generally flat front face and at least one sloped surface extending downwardly at an acute angle in relation to an upper portion of said front face, and an elastomeric pad adapted to be received on said sloped surface, said sloped surface having a slot running lengthwise of said sloped surface generally parallel to an outer edge of said sloped surface, and said elastomeric pad having a protrusion running lengthwise along its rear face generally parallel to an outer edge of said elastomeric pad, said elastomeric pad protrusion adapted to be received in said sloped surface slot, wherein said elastomeric pad is wedge shaped with a taper of decreasing thickness from the bottom edge toward the top edge of the pad, and said sloped surface includes an indentation having a complementary taper of decreasing depth from the bottom edge toward the top edge formed by the upper surface of said sloped surface, with said elastomeric pad adapted to be received in said indentation in said sloped surface.

4. The friction shoe of claim 3 wherein a retaining lug protrudes from the bottom edge of said elastomeric pad, and a lip formed along a bottom edge of said sloped surface includes an opening adapted to receive said retaining lug.

5. The friction shoe of claim 3 wherein said elastomeric pad includes a bottom surface comprising two generally planar surfaces joined to form an obtuse planar angle therebetween such that the base of said angle is generally parallel to a side edge of said pad.

6. The friction shoe of claim 5 wherein said elastomeric pad comprises an upper surface segment and a lower surface segment, said pad upper surface segment composed of a relatively hard material and said pad lower surface segment composed of a softer material than said upper pad segment with a higher coefficient of friction than said upper pad segment.

* * * * *